US011215040B2

(12) United States Patent
Baumann et al.

(10) Patent No.: US 11,215,040 B2
(45) Date of Patent: Jan. 4, 2022

(54) SYSTEM AND METHODOLOGY FOR MINIMIZING PERFORATING GUN SHOCK LOADS

(71) Applicant: Schlumberger Technology Corporation, Sugar Land, TX (US)

(72) Inventors: Carlos Erik Baumann, Austin, TX (US); David Damm, Rosharon, TX (US); Jose Escudero, Pearland, TX (US); Moises Enrique Smart, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 533 days.

(21) Appl. No.: 16/066,231

(22) PCT Filed: Nov. 18, 2016

(86) PCT No.: PCT/US2016/062632
§ 371 (c)(1),
(2) Date: Jun. 26, 2018

(87) PCT Pub. No.: WO2017/116581
PCT Pub. Date: Jul. 6, 2017

(65) Prior Publication Data

US 2020/0270973 A1 Aug. 27, 2020

Related U.S. Application Data

(60) Provisional application No. 62/271,717, filed on Dec. 28, 2015.

(51) Int. Cl.
*E21B 43/117* (2006.01)
*F42D 3/00* (2006.01)
(Continued)

(52) U.S. Cl.
CPC ..... *E21B 43/117* (2013.01); *E21B 43/116* (2013.01); *F42D 3/00* (2013.01); *E21B 43/1185* (2013.01)

(58) Field of Classification Search
CPC .. E21B 43/116; E21B 43/117; E21B 43/1185; F42D 3/00
See application file for complete search history.

(56) References Cited

U.S. PATENT DOCUMENTS 7,011,027 B2 * 3/2006 Reese ..... F42B 1/032 102/307
7,712,532 B2 * 5/2010 Walton ..... E21B 43/116 166/298

(Continued)

FOREIGN PATENT DOCUMENTS

WO WO2014123510 A1 8/2014

OTHER PUBLICATIONS

International Preliminary Report on Patentability issued in the related PCT Application PCT/US2016/062632, dated Jul. 3, 2018 (5 pages).

(Continued)

*Primary Examiner* — Yong-Suk (Philip) Ro
(74) *Attorney, Agent, or Firm* — Cameron R. Sneddon

(57) ABSTRACT

A technique facilitates perforating along specific regions of a wellbore without creating detrimental transient pressure changes along a perforating gun string. In non-perforation regions, pressure charges may be used to maintain pressure within the gun string without creating perforations through the surrounding casing and into the surrounding formation. Each pressure charge may comprise a casing with an explosive material disposed in the casing. However, the components and structure of the pressure charge enable detonation (Continued)

and the corresponding increase in pressure within the gun string without creating perforations.

20 Claims, 3 Drawing Sheets

(51) Int. Cl.
*E21B 43/116* (2006.01)
*E21B 43/1185* (2006.01)

(56) References Cited

U.S. PATENT DOCUMENTS 8,677,903 B2 * 3/2014 Marya ..... E21B 43/116 102/306
2005/0061506 A1 * 3/2005 Grove ..... E21B 21/00 166/297
2007/0107616 A1 * 5/2007 Grove ..... E21B 43/116 102/306
2008/0282924 A1 * 11/2008 Saenger ..... F42B 1/032 102/306
2009/0151948 A1 6/2009 Behrmann et al.
2010/0243323 A1 9/2010 McCann et al.
2013/0048376 A1 2/2013 Rodgers et al.
2013/0140023 A1 6/2013 Baumann et al.
2015/0316359 A1 * 11/2015 Hales ..... E21B 43/117 175/4.57

OTHER PUBLICATIONS

International Search Report and Written Opinion issued in the related PCT Application PCT/US2016/062632, dated Feb. 15, 2017 (9 pages).
Examination Report issued in GB application GB1810626.0, dated Feb. 1, 2021 (4 pages).

* cited by examiner

SYSTEM AND METHODOLOGY FOR MINIMIZING PERFORATING GUN SHOCK LOADS

CROSS-REFERENCE TO RELATED APPLICATION

The present document is based on and claims priority to U.S. Provisional Application Ser. No.: 62/271,717, filed Dec. 28, 2015, which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, a perforating gun string with shaped charges may be used to perforate the hydrocarbon-bearing formation for enhanced production of the reservoir fluids. Sometimes, perforating wells with casing/carrier guns can create large transient pressure changes in the wellbore in the form of, for example, dynamic pressure under-balance or over-balance. This phenomenon and the corresponding side effects tend to be much more pronounced when the perforating guns are partially loaded to perforate specific zones along the formation. For example, the substantially lower pressure in unloaded regions of the perforating gun can create very large dynamic loads which can damage completion tools, e.g. tear packer seals, unset packers, buckle tubing, collapse casing, separate sections of the gun string, and/or cause other types of damage.

SUMMARY

In general, a system and methodology are provided for enabling perforating along specific regions of a wellbore without creating detrimental transient pressure changes along a perforating gun string. In non-perforation regions, pressure charges may be used to maintain pressure within the gun string without creating perforations through the surrounding casing and into the surrounding formation. Each pressure charge may comprise a casing with an explosive material disposed in the casing to create desired pressure effects. The components and structure of the pressure charge enable detonation and the corresponding increase in pressure within the gun string without creating perforations.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
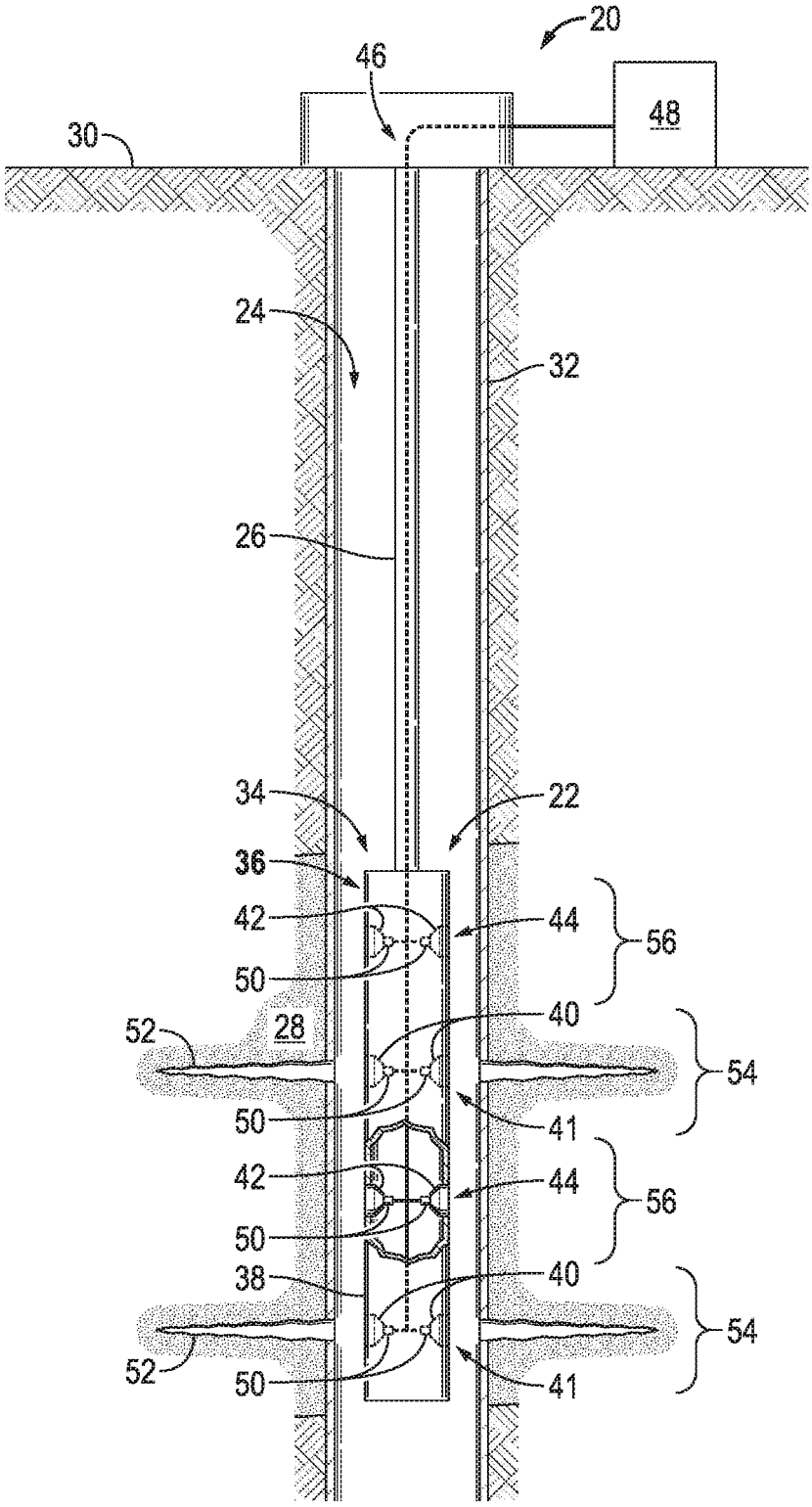
FIG. 1 is a schematic illustration of an example of a well system comprising a perforating gun string deployed in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology for enabling perforating along specific regions of a wellbore without creating detrimental transient pressure changes along a perforating gun. For example, the system and methodology may be used to maintain a more consistent internal pressure along an interior of the perforating gun, including through non-perforating sections, upon detonation of shaped charges to create perforations in desired well zones. In the non perforation sections, pressure charges may be deployed along the perforating gun to maintain pressure within the gun string without creating perforations through the surrounding casing and into the surrounding formation.

According to an embodiment, each pressure charge may comprise a casing with an explosive material disposed in the casing. However, the components and structure of the pressure charge enable detonation without creating perforations. Consequently, a more even pressure loading occurs along the interior of the perforating gun throughout perforating sections and non-perforating sections of the gun string.

In various perforating applications, a perforating gun string is deployed downhole into a wellbore and comprises a perforating gun having perforating sections and non-perforating sections. The perforating sections may be loaded with shaped charges oriented to create perforations through a surrounding wellbore casing and into perforation zones of the surrounding formation. However, the non-perforating sections of the gun may be loaded with pressure charges which are constructed with explosive material that may be detonated to create pressures along the perforating gun to help balance pressures created by detonation of the shaped charges. The pressure charges are able to minimize transient pressure differentials along the perforating gun without creating perforations through the surrounding casing or geologic formation.

In one example, each pressure charge comprises a casing containing an energetic, explosive material. Additionally, each pressure charge comprises a jet-off part positioned to arrest formation of a perforating jet. Use of the jet-off part enables effective loading of the perforating gun completely without damaging the casing or puncturing the gun carrier along non-perforating sections of the perforating gun and along corresponding non-perforation sections of the geologic formation. In some embodiments, other components may be used in addition to or in place of the jet-off part to arrest formation of the perforating jet. As explained in greater detail below, some embodiments utilize a strategically placed energetic, explosive material which acts to prevent formation of a jet able to perforate the surrounding casing.

The pressure charges serve to minimize differences in the transient wellbore pressures between the top and bottom of the gun string. As a result, the otherwise detrimental initial gun shock loading is reduced or removed, thus minimizing potential damage to perforating system components, e.g. damage to the deployment tubing and/or wireline cable. Placement of the pressure charges also can be used to minimize the magnitude of dynamic under balance otherwise produced by partially loaded perforating guns. This further helps to minimize the transient pressure differentials acting on other system components, e.g. packers, tubulars, and perforating guns. Minimization of the transient pressure differentials also reduces the risk of pressure loading causing sanded-in or stuck perforating guns when used in unconsolidated formations.

Referring generally to FIG. 1, an example of a well system 20 is illustrated as comprising a perforating system 22 deployed in a wellbore 24 via a conveyance 26, e.g tubing or wireline cable. In this example, the wellbore 24 extends into a subterranean geologic formation 28 from a surface location 30 and is lined with a casing 32. The perforating system 22 comprises a perforating gun string 34 having a perforating gun 36 with a perforating gun body 38. The perforating gun body 38 may have a variety of structures and may be constructed with many types of components according to the parameters of a given perforating application. A plurality of shaped charges 40 may be mounted to the perforating gun 36, and each of the shaped charges 40 may be oriented outwardly from the perforating gun 36 along perforating sections 41 of the perforating gun 36. Additionally, a plurality of pressure charges 42 may be mounted to the perforating gun 36 at desired non-perforating sections 44 of the perforating gun 36.

The shaped charges 40 and the pressure charges 42 are connected with a detonation system 46 having a detonation control 48 which provides signals to a detonator or detonators 50 to initiate detonation of shaped charges 40 and pressure charges 42. In many applications, the shaped charges 40 and pressure charges 42 are detonated simultaneously to provide a relatively uniform buildup of pressure within perforating gun 36. Upon detonation, the shaped charges 40 explode and create a jet of material which is propelled outwardly to create perforations 52 which extend through casing 32 and into the surrounding subterranean formation 28 at desired perforation zones 54.

The pressure charges 42 also explode upon detonation to create the desired pressure buildup which minimizes transient pressure differentials along perforating gun 36. Additionally, the components and configuration of the pressure charges 42 further ensure that no jets are created that would form perforations through casing 36, thus maintaining non-perforation zones 56 which correspond with the non-perforation sections 44 of gun string 34. The number and arrangement of shaped charges 40 and pressure charges 42 may vary depending on the parameters of a given perforation application.

Figure 2:
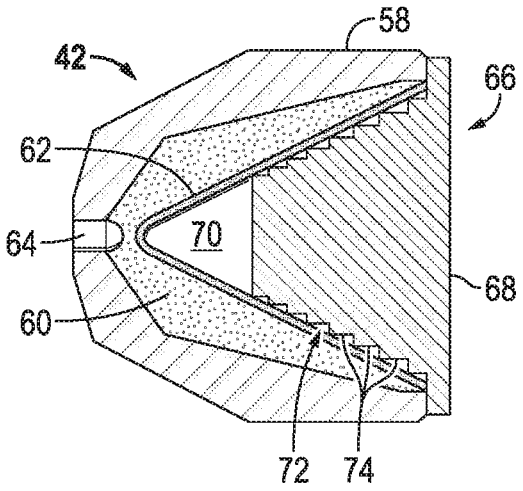
FIG. 2 is a cross-sectional illustration of an example of a pressure charge which may be located in a non-perforation section of the gun string, according to an embodiment of the disclosure.

Referring generally to FIG. 2, an embodiment of one of the pressure charges 42 is illustrated in cross-section. In this example, the pressure charge 42 comprises a casing 58 which may be formed of a steel material, other metal, or other suitable type of material. An energetic, explosive material 60 is disposed in casing 58 and a liner 62 may be disposed along an interior area of the explosive material 60. The explosive material 60 may be detonated by a primer 64 positioned in cooperation with detonator 50.

In some embodiments, a component 66 is located at least partially within liner 62 to resist collapse of the liner 62, thus resisting formation of a perforating jet upon detonation of explosive material 60. The component 66 enables the conversion of shaped charges into pressure charges which are not able to form perforating jets in the non-perforation zones 56. Depending on the application, the component 66 may be mounted to liner 62, casing 58, and/or another suitable portion of pressure charge 42 via an adhesive, a fastener, a press fit, or another suitable engagement technique.

Figure 3:
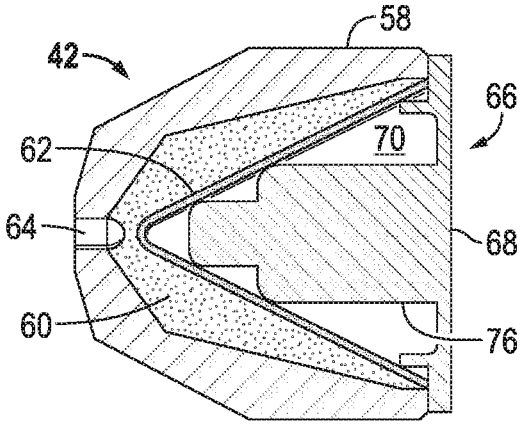
FIG. 3 is a cross-sectional illustration of another example of a pressure charge which may be located in a non-perforation section of the gun string, according to an embodiment of the disclosure.

In the example illustrated in FIG. 2, component 66 comprises a jet-off part 68 which is formed of a suitable material and extends at least partially into an interior 70 of liner 62. By way of example, the jet-off part 68 may comprise a stepped core 72 having a stepped exterior surface 74 formed generally along a truncated, conical shape. In some applications, the exterior surface 74 may be a generally smooth surface. However, the jet-off part 68 may have a variety of other shapes and configurations, including a shape comprising a barrel core 76, i.e. a barrel-shaped core, which extends into interior 70 of liner 62, as illustrated in FIG. 3.

Figure 4:
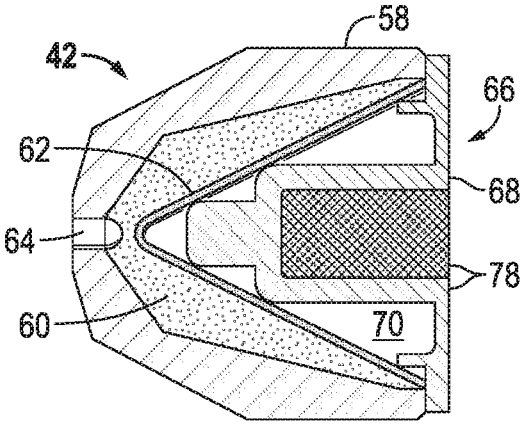
FIG. 4 is a cross-sectional illustration of another example of a pressure charge which may be located in a non-perforation section of the gun string, according to an embodiment of the disclosure.

The jet-off part 68 may be formed from a variety of materials, including high density materials. Depending on the application, the jet-off part 68 may be formed from a metal material, a plastic material, or another suitable material. As illustrated in FIG. 4, for example, the jet-off part 68 may be formed as a composite component having a plurality of materials 78. By way of example, the plurality of material 78 may comprise various mixtures or arrangements of plastic materials and metal materials. The configuration of jet-off part 68 and material/materials 78 is selected to interrupt formation of a perforating jet upon detonation of explosive material 60. However, detonation of the explosive material 60 of pressure charges 42 causes a similar increase in pressure within perforating gun 36 as that which results from detonation of shaped charges 40. The similar pressure increases along the interior of perforating gun 36 minimizes the magnitude of dynamic under balance that would otherwise be produced by partially loaded perforating guns and also minimizes the transient pressure differentials along perforating gun 36 but without perforating the surrounding casing 32 or geologic formation 28 in the non-perforation zones 56.

Figure 5:
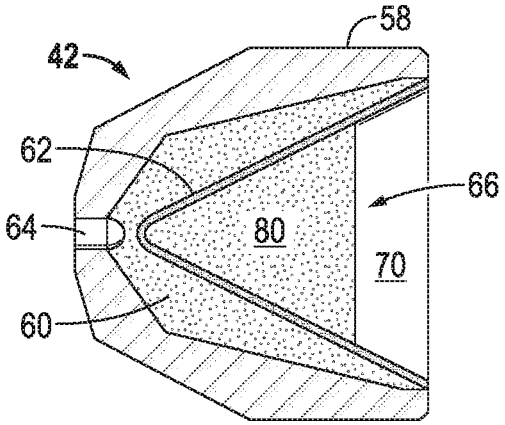
FIG. 5 is a cross-sectional illustration of another example of a pressure charge which may be located in a non-perforation section of the gun string, according to an embodiment of the disclosure.
Figure 6:
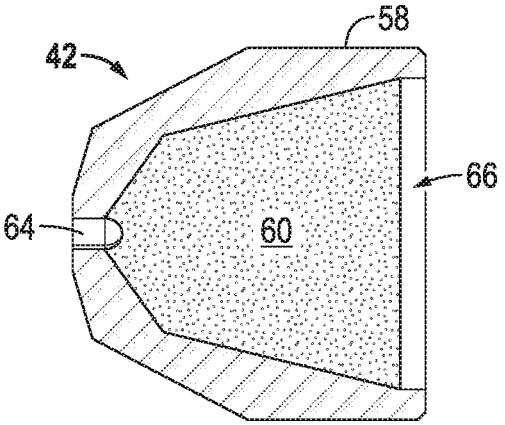
FIG. 6 is a cross-sectional illustration of another example of a pressure charge which may be located in a non-perforation section of the gun string, according to an embodiment of the disclosure.

Referring generally to FIG. 5, another embodiment of pressure charge 42 is illustrated. In this embodiment, component 66 comprises an internal energetic, explosive material 80. The internal explosive material 80 is disposed at least partially in interior 70 within liner 62. When the main explosive material 60 is detonated, the internal explosive material 80 also explodes to prevent or sufficiently inhibit collapse of liner 62, thus preventing formation of a perforating jet. In some applications, the energetic, explosive material 60 may simply be located within casing 58 without liner 62, as illustrated in FIG. 6. This latter type of arrangement enables detonation of the explosive material 60 to create the desired pressure increase but without having components, e.g. liner 62, able to form a perforating jet.

Figure 7:
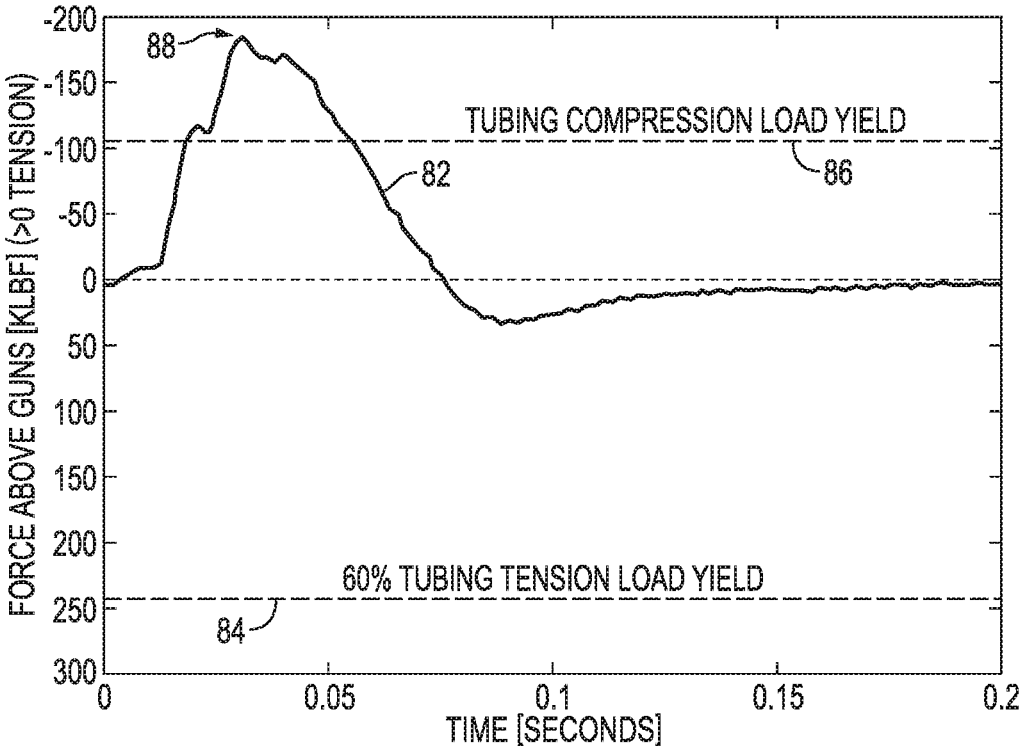
FIG. 7 is a graphical illustration showing loading versus time along a perforating gun having a non-perforating section without pressure charges, according to an embodiment of the disclosure.
Figure 8:
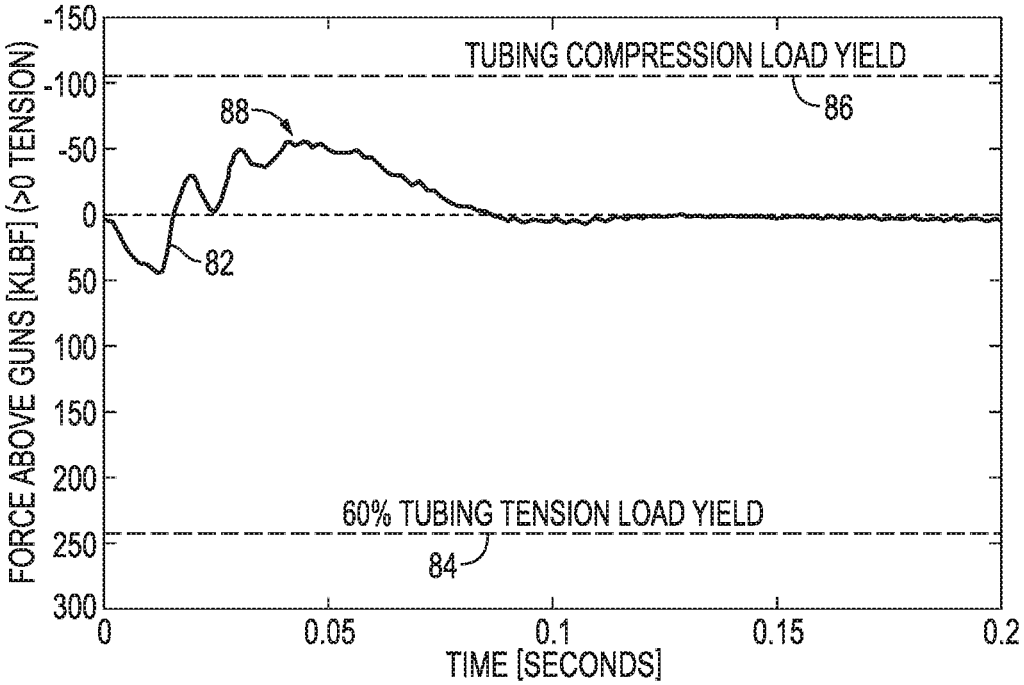
FIG. 8 is a graphical illustration showing loading versus time along a perforating gun having a non-perforating section with pressure charges located along the non-perforating section, according to an embodiment of the disclosure.

Referring generally to FIGS. 7 and 8, graphical illustrations of loading versus time are provided to illustrate the effectiveness of the jet-off part 68. In FIG. 7, a peak compression loading on tubing of perforating gun string 34 is illustrated by graph line 82; a baseline gun string loading is represented by graph line 84; and a tubing compression load yield is represented by graph line 86. In this example, detonation of a partially loaded perforating gun (without pressure charges 42) causes a peak compression load 88 which exceeds the tubing compression load yield 86, thus damaging the gun string 34.

However, when jet-off parts 68 are utilized to form pressure charges 42 in the non-perforation sections 44 of gun string 34, the transient tubing load becomes more balanced as illustrated graphically in FIG. 8. As illustrated, the peak compression load 88 remains substantially below the tubing compression load yield graph line 86. Thus, the jet-off parts 68 are able to minimize the tubing load in a perforating application in which certain zones are not to be perforated. It should be noted that other embodiments of pressure charges 42, e.g. embodiments utilizing internal explosive material 80 within liner 62 or explosive material 60 without liner 62, can be used to achieve similar results.

The embodiments of pressure charges 42 described herein are able to minimize undesirable effects of partially loaded perforating guns. In some applications, the jet-off part 68 may be combined with shaped charges to prevent formation of a perforating jet able to puncture casing 32. In other words, certain embodiments enable retrofitting of shaped charges 40 to create pressure charges 42 which prevent perforation of casing 32 in non-perforation zones 56 while enabling the desirable pressure effects along the perforating gun 36.

Depending on the application, the jet-off parts 68 may be made from different materials and in a variety of different shapes. In some applications, the jet-off parts 68 may be made of relatively dense materials to arrest the perforating jet. For some perforating operations, hard, non-metallic materials may be used and/or various composite materials may be used to prevent formation of the perforating jet. Additionally, the jet-off part 68 may be symmetrical about a central axis, however some embodiments may use asymmetric shapes with respect to the central axis to achieve desired perforating jet arresting effects. As described herein, energetic, explosive materials also may be used within liner 62 or without liner 62 to arrest formation of the perforating jet.

Depending on the application, the overall well system 20 also may have a variety of configurations and/or components. Similarly, the detonation system 46 may have various configurations and components for use in many types of perforating operations. The shaped charges 40 may be positioned along a single perforation zone or along a plurality of perforation zones. Similarly, the pressure charges 42 may be positioned along a single non-perforation zone or along a plurality of non-perforation zones. The amount of explosive material utilized as well as the configuration of the shaped charge components and pressure charge components may be adjusted according to the parameters of a given perforation operation. The components 66 may be the same for each pressure charge or different types of components 66 may be used for different pressure charges at different locations along the gun string to achieve desired perforation and non-perforation zones.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for perforating, comprising:

a perforating gun string comprising:

a plurality of shaped charges oriented to create perforations in a surrounding formation upon detonation; and a plurality of pressure charges located in a non-perforation section of the perforating gun string to establish an increased gun pressure upon detonation without puncturing the perforating gun at the non-perforating section and creating perforations into the surrounding formation at the non-perforation section.

2. The system as recited in claim 1, wherein each pressure charge of the plurality of pressure charges comprises a casing containing an explosive material.

3. The system as recited in claim 2, wherein each pressure charge further comprises a liner and a jet-off part located at least partially within the liner to block collapse of the liner upon detonation of the pressure charge.

4. The system as recited in claim 2, wherein each pressure charge further comprises a liner and an energetic explosive material located within the liner.

5. The system as recited in claim 3, wherein the jet-off part comprises a stepped core positioned within the liner.

6. The system as recited in claim 3, wherein the jet-off part comprises a barrel core positioned within the liner.

7. The system as recited in claim 3, wherein the jet-off part is formed of a metal material.

8. The system as recited in claim 3, wherein the jet-off part is formed of a plastic material.

9. The system as recited in claim 3, wherein the jet-off part is formed of a composite material.

10. A method, comprising:

arranging a plurality of shaped charges along sections of a perforating gun corresponding with perforation zones of a well;

positioning a plurality of pressure charges along a portion of the perforating gun corresponding with a zone of the well not to be perforated;

deploying the gun string downhole into a wellbore drilled through the perforation zones of the well; and selectively detonating the plurality of shaped charges and the plurality of pressure charges to maintain a desired pressure along the interior of the perforating gun wherein the pressure charges do not puncture the perforating gun along non-perforating sections of the perforating gun while the shaped charges perforate the perforating zones of the well.

11. The method as recited in claim 10, further comprising forming each pressure charge with a casing containing an explosive material.

12. The method as recited in claim 11, further comprising locating a liner within the casing.

13. The method as recited in claim 11, further comprising positioning a jet-off part in the casing to prevent formation of a perforating jet upon detonating the plurality of shaped charges and the plurality of pressure charges.

14. The method as recited in claim 13, further comprising forming each jet-off part with a stepped core positioned in a liner located within the casing.

15. The method as recited in claim 13, further comprising forming each jet-off part with a barrel core positioned in a liner located within the casing.

16. The method as recited in claim 13, further comprising forming each jet-off part from a metal material.

17. The method as recited in claim 13, further comprising forming each jet-off part from a composite material.

18. A system, comprising:

a pressure charge for use in a perforating gun string to maintain pressure in a non-perforation section of the perforating gun string, the pressure charge comprising:

a casing;

an explosive material disposed in the casing;

a liner located along an interior area of the explosive material; and a component located within the liner to resist formation of a perforating jet by obstructing collapse of the liner.

19. The system as recited in claim 18, wherein the component comprises a jet-off part.

20. The system as recited in claim 18, wherein the component comprises an energetic explosive material located within the liner.

* * * * *